US006802799B2

(12) United States Patent
Gomez

(10) Patent No.: US 6,802,799 B2
(45) Date of Patent: Oct. 12, 2004

(54) KARATE KICK EXERCISE APPARATUS

(76) Inventor: Jorge A. Gomez, 10234 Hayford St., Norwalk, CA (US) 90650

( * ) Notice: Subject to any disclaimer, the term of this patent is extended or adjusted under 35 U.S.C. 154(b) by 164 days.

(21) Appl. No.: 10/298,388

(22) Filed: Nov. 19, 2002

(65) Prior Publication Data

US 2004/0097346 A1 May 20, 2004

(51) Int. Cl.[7] ..... A63B 69/311
(52) U.S. Cl. ..... 482/83; 482/87; 482/90
(58) Field of Search ..... 482/112, 83–90, 482/95, 96, 79–80; 473/441, 442, 438, 907

(56) References Cited

U.S. PATENT DOCUMENTS 2,644,334 A * 7/1953 Perry
2,514,105 A * 5/1970 Pilliard
3,827,690 A * 8/1974 Rogers
3,897,060 A * 7/1975 Jenning
4,491,316 A 1/1985 Prince
4,872,670 A * 10/1989 Nichol
4,964,629 A 10/1990 Wright
4,973,045 A 11/1990 Heberer
5,143,372 A * 9/1992 Wilson
5,458,551 A 10/1995 Shenton

* cited by examiner

*Primary Examiner*—Jerome W. Donnelly
(74) *Attorney, Agent, or Firm*—Howard A. Kenyon

(57) ABSTRACT

An apparatus for practicing martial arts defensive acts such as Karate kicking. The Karate Kick Exercise apparatus has a base frame, which is attached to a surface. The base frame has upright members that pivot on the base frame. The upright members have a top frame that also pivots on the upright members. A kicking target is attached to a kicking surface member, which in turn is attached to the top frame. The upright members are held in place by a spring-loaded air cylinder that holds the apparatus upright and provides means of absorbing the blows provided by a kicker. The frame pivots in the same direction as the air cylinder.

10 Claims, 2 Drawing Sheets

KARATE KICK EXERCISE APPARATUS

BACKGROUND OF THE INVENTION

1. Field of the Invention

This invention relates to an apparatus used in training a student in martial arts such as Karate where the student is leaning the process of kicking with a bare foot or striking with the side of a bare hand.

2. Description of the Prior Art

There are a number of devices that have been designed to train a student in the field of martial arts. U.S. Pat. No. 4,964,629 to Wright describes an apparatus that provides an adjustable resistance force such as a kick. Wright describes a complex system of pulleys and weights whereby the student stands on one foot on a platform suitably adjusted for the student's height and places his other foot on a slide block and gives a kick. A slide block slides in the slide assembly to a final position restrained by resistance means which Wright describes as pulleys thereby giving the student exercise for those muscles specifically associated with a kick.

U.S. Pat. No. 4,491,316 to Prince is a very complex apparatus that includes a target to be kicked which will provide intensity as well as whether the kick has landed in the correct position on the target. An electrical sensing circuit will give the student a visual result of the efficiency of the kick.

U.S. Pat. No. 5,458,551 to Shenton describes a reusable break-a-way board assembly used in martial arts training. This invention simulates breaking of a board even though the board does not actually break. The breaking assembly uses a breaking mechanism, which closely simulates the conditions required for the breaking of a real board.

U.S. Pat. No. 4,973,045 to Heberer describes an apparatus for positioning and securing at least one target board at a particular height and angle for the practice of martial arts.

All of the above patents do not provide a spring-load air cylinder that can be adjusted to provide variable resistance for the kicking target and the air cylinder that provides spring means to bring the kicking target back to its original position.

Accordingly, a fuller understanding of the invention may be obtained by referring to the Summary of the Invention, and the Detailed Description of the Preferred Embodiment, in addition to the scope of the invention defined by the claims taken in conjunction with the accompanying drawings.

SUMMARY OF THE INVENTION

It is the object of the present invention to provide an apparatus to train a student in martial arts and the process of Karate kicking.

It is another object of the present invention to provide a frame containing a padded target where the martial arts kicker can land the kick blows.

It is yet another object of the present invention whereby the base frame is permanently attached to a surface.

It is still another object of the present invention where the frame has attached thereto an air cylinder that contains a spring that returns the padded target to the original position after the martial arts kicker lands his blows.

Briefly, in accordance with the present invention, there is provided a frame, pivotally in the fore and aft direction, the frame being connected to an air cylinder that absorbs the blows of a kick and also returns the target to its original position which will be ready for the next kick blow.

Other objects and advantages will become apparent from the following description and appended claims taken in conjunction with the accompanying drawings.

DESCRIPTION OF THE DRAWINGS

In the drawings which illustrate the best mode contemplated for carrying out the present invention.

These and other objects, features and advantages of the present invention will come more readily apparent upon detailed consideration of the following Description of the Preferred Embodiments with reference to the accompanying drawings.

DESCRIPTION OF THE PREFERRED EMBODIMENT

Figure 1:
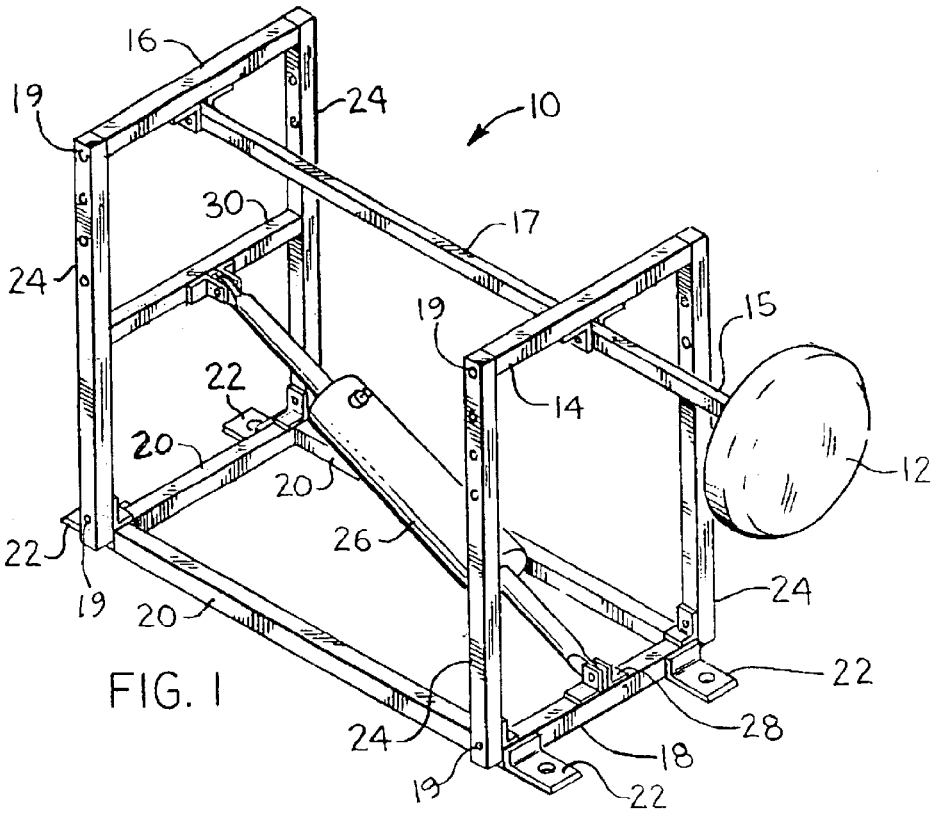
FIG. 1 is a perspective view of the Karate Kick Exercise Apparatus.

Turning now to FIG. 1 there is seen a perspective view of a Karate Kick Exercise Apparatus generally shown as 10. In this view there is seen a target 12, target primary member 15, target secondary member 17, target frame primary member 14, and target frame secondary member 16. Also seen in this figure is a base frame having primary member 18 and three secondary members 20. FIG. 1 also shows ears 22 that are used to fasten said base frames primary member 18 and three secondary members 20 to a surface. Upright members 24 pivotally connect said top frames primary member 14 and target frame secondary members 16 to said base frame primary members 18 and three secondary members 20. FIG. 1 also shows an air cylinder 26 that is pivotally connected to a first connecting member 28 on one end. The air cylinder on the other end is pivotally connected to a second connecting member 30. The pivot means of the frame member 24 pivoting on base frame primary member 18 and three secondary members 20 is by clevis pins or bolts (not shown) loosely fitted in pivotal holes (not shown). Similarly, the upright members 24 on said target frame secondary members 16 and target frame primary member 14 by clevis pins 19 or bolts (not shown) loosely fitted in the pivot holes.

Figure 2:
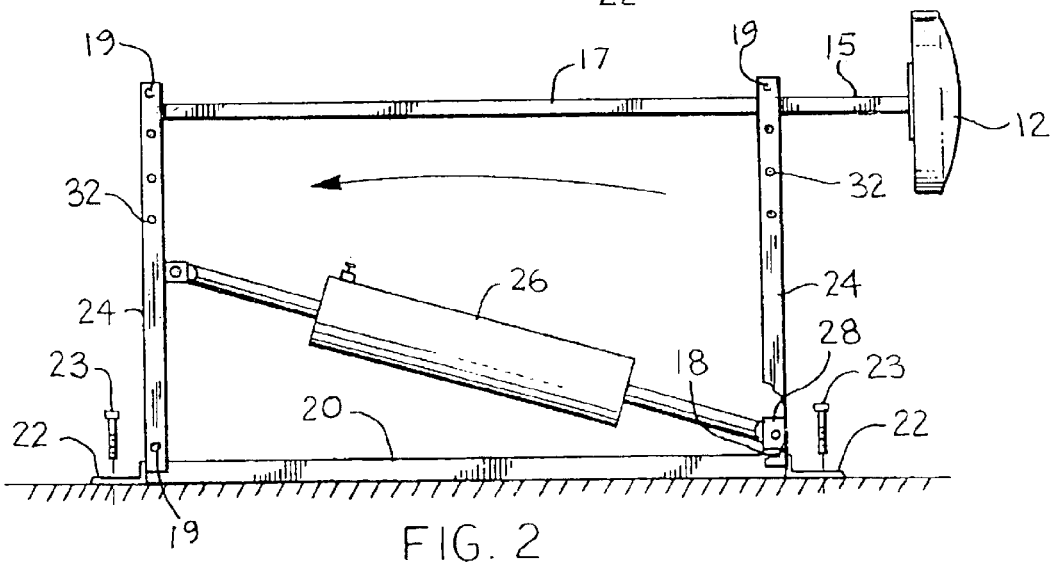
FIG. 2 is a left side view of the Karate Kick Exercise Apparatus, the right side being a mirror image.

FIG. 2 shows a side view of the Karate Kick Exercise Apparatus showing upright members 24 with holes 32 through upright members 24. These holes 32 are evenly spaced apart. The top frame member 14 and target frame secondary member 16 are attached to the upright members 24 by removable clevis pins 19. The removable clevis pins 19 have means to prevent the clevis pin 19 from being unintentionally removed. The means to keep the clevis pins 19 from being unintentionally removed can be a nut (not shown) threaded on the clevis pin 19 or a cotter pin (not shown) through the end of the clevis pin 19. The height of the frame and hence the target can be adjusted to compensate for and accommodate the height of any user. The air cylinder 26 is also seen in this view being attached on one end to said primary member 18 and on the other end to member 30. In this view is also seen the ears 22 that have attaching means 23 which could be bolts or screws to attach the Karate Kick Exercise Apparatus to a floor surface.

Figure 3:
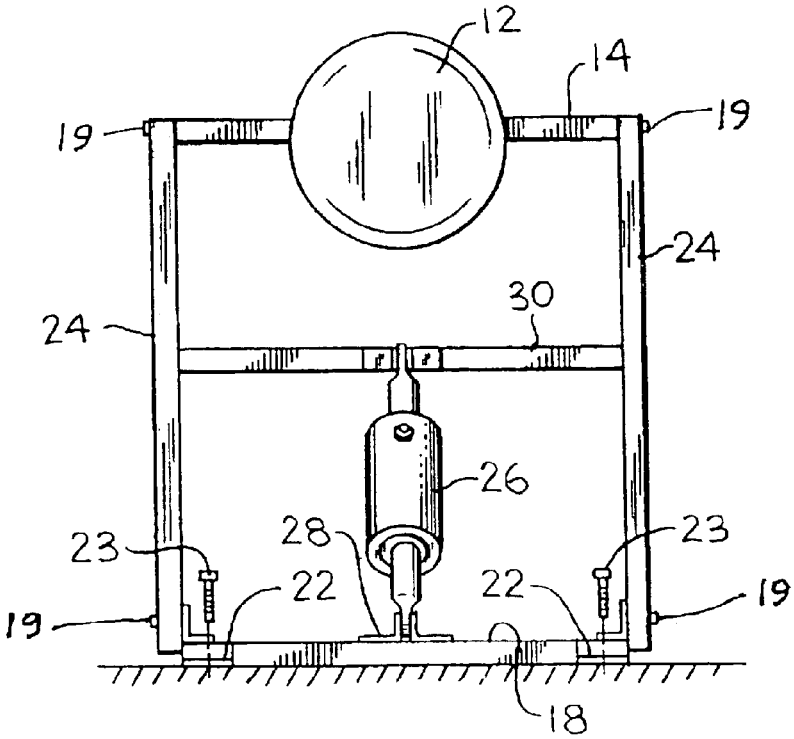
FIG. 3 is a front view of the Karate Kick Exercise Apparatus.

FIG. 3 shows a front view of the Karate Kick Exercise Apparatus showing the target 12. The target 12 is covered with a soft material such as sponge rubber (not shown) to prevent injury to the user's foot or hand when a blow is delivered to the target 12. Members 14, and members 24 and 30 are also seen in this view.

Figure 4:
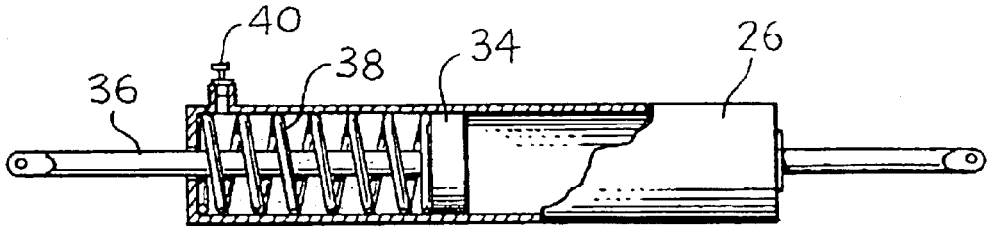
FIG. 4 is a side view of an air cylinder with a cut-away section showing a piston, piston rod, return spring and an airflow adjustment.

FIG. 4 shows a side view of the air cylinder 26 further showing a cut-away view of the cylinder 26. In this cut-away view there is seen piston 34, piston rod 36 and the return spring 38. Also seen in this view is adjusting means 40 that adjusts the rate which the air flows to and from the cylinder 26.

The key to this invention is the air cylinder 26 and the air adjusting means 40. The spring rate of the return spring is also important to move the target 12 back to its original position. The adjusting air means 40 can provide training to a user who has a weak kick as well as to a user who has a strong kick.

The use of the present invention for practicing a Karate kick is very simple. The user stands on one foot and kicks the target 12 which transfers the force of the kick to the target member 15 which further transfers the force to the top frame primary member 14. This in turn moves secondary member 17 longitudinally which moves frame secondary member 16 that also moves the vertical members 24 whereby the vertical members 24 pivot about the base frames 18 and 20. The vertical members 24 movement causes the second connecting member 30 to move which is partially restrained by the air cylinder. The amount of restraint depends on the adjustment 40 in FIG. 4 of the rate of travel preset on the air cylinder. When the kicking force has been fully terminated, the internally captured spring 38 in FIG. 4 returns the air cylinder to its original position which then is available for another kick by the user.

Thus, it is apparent that there has been provided, in accordance with the invention, an apparatus for practicing a Karate kick that fully satisfies the objectives, aims, and advantages set forth above. While the invention has been described in conjunction with specific embodiment thereof, it is evident that many alternatives, modifications, and variations will be apparent to those skilled in the art in light of the foregoing description. Accordingly, it is intended to embrace all such alternatives, modifications, and variations that fall within the spirit and scope of the appended claims.

What is claimed:

1. An apparatus useful in practicing a Karate kick by a martial arts practioner comprising:

a rectangular base frame, said rectangular base frame having a primary member and three secondary members, said rectangular base frame having ears attached to each corner of said base frame, said ears having holes therein, said holes receiving fastening means to fasten said base frame to a surface;

vertical members pivotally attached by pivot means to said base frame at each corner of said base frame, said vertical members having in the upper portion holes equally spaced on each of said vertical members;

a top frame having a primary member and a secondary member, said top frame pivotally attached to said vertical members by pivot means, said pivot means being captured by removable clevis pins;

a target, having a target member attached to said target, said target member attached to said primary member of said rectangular top frame;

an air cylinder, said air cylinder having a first connecting member pivotally attached on one end, said first connecting member being attached to said primary member of said base frame, said air cylinder having a second connecting member pivotally attached on the other end, said second connecting member being attached on each end to said vertical members.

2. An apparatus useful in practicing a Karate kick as described in claim 1 wherein said vertical members pivot means on said base frame are by captured clevis pins.

3. An apparatus useful in practicing a Karate kick as described in claim 1 wherein said target is conical in shape and said target is lined with a blow softening material such as sponge rubber.

4. An apparatus useful in practicing a Karate kick as described in claim 1 wherein said vertical members have adjusting means to lower said top frame which lowers said target to accommodate users of smaller statue practicing said Karate kick.

5. An apparatus useful in practicing a Karate kick as described in claim 4 wherein said adjusting means of said vertical members are by captured but removable clevis pins in equally spaced holes on said vertical members.

6. An apparatus useful in practicing a Karate kick as described in claim 1 wherein said air cylinder has adjusting means for adjusting the rate of travel when a blow to said target actuates said air cylinder.

7. An apparatus useful in practicing a Karate kick as described in claim 1 wherein said air cylinder has an internal captured spring that returns the air cylinder to its original position when Karate kick force is terminated.

8. An apparatus useful in practicing a Karate kick as described in claim 1 wherein a user having delivered said kick to said target provides movement in said air cylinder which in turn reduces the impact.

9. An apparatus useful in practicing a Karate kick as described in claim 1 wherein said vertical members pivot in the direction away from said Karate kick.

10. An apparatus useful in practicing a Karate kick as described in claim 1 wherein said user places a kick on said target, the blow on said target member moves said primary member of said top frame which in turn moves said rectangular top frame laterally which pivots about said vertical members which in turn moves said second connecting member which is attached to said air cylinder, said air cylinder being positioned to move and absorb the force of the blow, said air cylinder returning to its original position by the internal captured spring.

* * * * *